US007051490B2

(12) United States Patent
Oishi et al.

(10) Patent No.: US 7,051,490 B2
(45) Date of Patent: May 30, 2006

(54) DOOR FOR REFRIGERATOR AND METHOD OF PRODUCING THE DOOR FOR REFRIGERATOR

(75) Inventors: Takashi Oishi, Tokyo (JP); Shou Hanaoka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 67 days.

(21) Appl. No.: 09/847,084

(22) Filed: May 3, 2001

(65) Prior Publication Data

US 2002/0066258 A1 Jun. 6, 2002

(30) Foreign Application Priority Data

Dec. 1, 2000 (JP) ..... 2000-367595
Jan. 29, 2001 (JP) ..... 2001-020192

(51) Int. Cl.
*F04C 2/54* (2006.01)

(52) U.S. Cl. ..... 52/784.15; 52/309.7; 52/784.13; 52/783.19; 52/792.1; 52/794.1; 52/798.1; 52/801.12; 49/501; 312/405

(58) Field of Classification Search ..... 52/784.13, 52/784.15, 787.11, 794.1, 804, 738, 309.11, 52/783.19, 792.1, 798.1, 801.12, 309.7; 49/501, 49/460, 478, 487, 489; 29/460, 423; 40/405, 40/406; 312/405
See application file for complete search history.

(56) References Cited

U.S. PATENT DOCUMENTS 2,718,446 A * 9/1955 Hinkel
3,286,004 A * 11/1966 Hill et al.
3,634,971 A * 1/1972 Kesling ..... 49/460

(Continued)

FOREIGN PATENT DOCUMENTS

| | | |
|---|---|---|
| JP | 55-54885 | 10/1953 |
| JP | 60-58270 | 4/1985 |
| JP | 63-104982 | 7/1988 |
| JP | 3-25272 | 2/1991 |
| JP | 862706-1 | 3/1993 |
| JP | 06-213560 | 8/1994 |
| JP | HE16-213560 | 8/1994 |
| JP | 7-146058 | 6/1995 |
| JP | 07-237344 | 9/1995 |
| JP | HEI7-237344 | 9/1995 |
| JP | 9-79736 | 3/1997 |
| JP | 10-30175 | 11/1998 |
| JP | 1034575 | 3/1999 |
| JP | 2000-97550 | 4/2000 |
| JP | 2000-097550 | 4/2000 |
| JP | 2000-229372 | 8/2000 |
| JP | 2002-013867 | 1/2002 |

OTHER PUBLICATIONS

Deep Drawing Manufacturing and Stamping, 2000, Toledo Spinning Co.*

(Continued)

*Primary Examiner*—Carl D. Friedman
*Assistant Examiner*—Yvonne M. Horton
(74) *Attorney, Agent, or Firm*—Oblon, Spivak, McClelland, Maier & Neustadt, P.C.

(57) ABSTRACT

A door for refrigerator which is sophisticated in design and provided at a lower production cost. The door for refrigerator is composed of a door panel made of metal and an inner plate combined with the door panel in a facing manner, a door cap which fits into the door panel and the inner panel in an upper portion, and a handle which fits into the door panel and the inner panel in a bottom portion. In addition to that, the door for refrigerator has a heat insulating form material injected inside. Then, the door for refrigerator is provided with draw forming at a position near to the edge of at least either side of the door panel.

8 Claims, 4 Drawing Sheets

$B \leqq A \times 10\%$

2 : INNER PLATE
6 : HEAT INSULATING FOAM MATERIAL

U.S. PATENT DOCUMENTS 3,732,646 A * 5/1973 Horvay et al. ..... 49/487
3,882,637 A * 5/1975 Lindenschmidt ..... 49/501
4,134,626 A * 1/1979 Kordes ..... 312/214
4,441,301 A * 4/1984 Benson ..... 52/804
4,536,990 A * 8/1985 Siegrist et al. ..... 49/501
4,583,796 A * 4/1986 Nakajima et al. ..... 312/405
4,614,552 A * 9/1986 Fortin et al. ..... 148/417
4,740,042 A * 4/1988 Stich et al. ..... 312/321.5
5,369,901 A * 12/1994 Revlett ..... 40/405
5,568,712 A * 10/1996 Jenkins et al. ..... 52/782.1
5,588,731 A * 12/1996 Schmidt et al. ..... 312/405
5,599,081 A * 2/1997 Revlett et al. ..... 312/406
5,909,937 A * 6/1999 Jenkins et al. ..... 312/405.1
5,916,643 A * 6/1999 Spain et al. ..... 428/31
5,941,624 A * 8/1999 Pfeffer et al. ..... 312/405.1
5,975,661 A * 11/1999 Banicevic ..... 29/460
6,138,432 A * 10/2000 Banicevic ..... 52/84.15
6,187,252 B1 * 2/2001 Rhoades et al. ..... 264/545
6,190,490 B1 * 2/2001 Tippmann et al. ..... 156/245
6,339,949 B1 * 1/2002 Takamatu ..... 72/347
6,419,778 B1 * 7/2002 Miyake et al. ..... 156/222

OTHER PUBLICATIONS

Written Opposition 2003–72444 (w/partial English translation).

"McGraw–Hill Dictionary of Scientific and Technical Terms" Fifth Edition, page 748, 2000 printed in Japan (partial English translation).

"Dictionary of Katakana Loanword/Abbreviation", page 172, Copyright 2000 (partial English translation).

"Dictionary of Katakana Loanword/Abbreviation", page 172, Copyright 2000.

"McGraw–Hill Dictionary of Scientific and Technical Terms" Third Edition, page 748, 2000 printed in Japan.

* cited by examiner

7 : GRADATION PORTION
8 : DRAW FORMING PORTION

9 : BOUNDARY

DOOR FOR REFRIGERATOR AND METHOD OF PRODUCING THE DOOR FOR REFRIGERATOR

BACKGROUND OF THE INVENTION

1. Field of the Invention

The present invention relates to a door for refrigerator and a method for producing the door for refrigerator.

2. Description of the Related Art

FIG. 7 is a perspective view illustrating a conventional door for refrigerator. Referring to the figure, a door 1 is composed of a door panel 3, an inner panel 2, a door cap 4 which is fitting into the upper portions of the door panel 3 and the inner panel 2, and a handle 5 which is fitting into the bottom portions of the door panel 3 and the inner panel 2. Inside the housing of the door 1, a heat insulating foam material is provided.

The door panel 3 is normally painted in a single color. The door 1 is also provided with a sheet metal part which is put between the door panel 3 and the heat insulating foam material. The sheet metal is supposed to keep the door panel 3 from getting uneven on the surface by a thermal shrinkage effect of the heat insulating foam material. The sheet metal part serves both for detaching the door panel 3 from the heat insulating foam material and for reinforcing the door panel 3.

As the conventional door for refrigerator is thus constructed, the door panel 3 would not look attractive in design if the door panel 3 has an uneven surface caused by the thermal shrinkage effect of the heat insulating foam material. For that reason, the sheet metal part is to be added both for detaching the door panel 3 from the heat insulating foam material and for reinforcing the door panel 3 so that the door panel 3 may not be stretched to cause the uneven surface by the thermal shrinkage of the heat insulating form material. Consequently, this leads to an extra production cost.

There is another problem of the conventional door for refrigerator in respect of the design of the front view of the door 1. The door 1 has such separate parts of injection as the door cap 4 and the handle 5 fitting into the door panel 3 in the upper portion and in the bottom portion, respectively. For that reason, there would be no problem to have some color pattern in the horizontal direction in the front view of the door 1 if the door cap 4 and the handle 5 are painted in a different color from that of the door panel 3. Having such color patterns in the vertical direction in the front view of the door 1, however, requires extra separate parts to be added on both sides of the door panel 3 because the door panel 3 is painted in a single color. Consequently, this also leads to an extra production cost.

SUMMARY OF THE INVENTION

One of the objects of the present invention is to provide a door for refrigerator which is sophisticated in design and also cuts production cost and a method of producing the door for refrigerator.

This and other objects of the embodiments of the present invention are accomplished by the present invention as hereinafter described in further detail.

According to one aspect of the present invention, a door for refrigerator is composed of a door panel made of metal, an inner panel combined with the door panel, a door cap fitting into the door panel and the inner panel in an upper portion, and a handle fitting into the door panel and the inner panel in a bottom portion. Furthermore, the door for refrigerator has a heat insulating foam material injected inside. Then, the door for refrigerator includes draw forming provided at a position near to an edge of at least either side of the door panel.

According to another aspect of the present invention, a door for refrigerator is composed of a door panel made of metal, an inner panel combined with the door panel, a door cap fitting into the door panel and the inner panel in an upper portion, and a handle fitting into the door panel and the inner panel in a bottom portion. Furthermore, the door for refrigerator has a heat insulating foam material injected inside. Then, the door for refrigerator includes draw forming provided at a given position of the door panel. The door panel may have a two-tone color, and the draw forming may be provided on a boundary of colors.

According to another aspect of the present invention, a method of producing a door for refrigerator, which is composed of a door panel made of metal, an inner panel combined with the door panel, a door cap fitting into the door panel and the inner panel in an upper portion, and a handle fitting into the door panel and the inner panel in a bottom portion, the door for refrigerator having a heat insulating foam material injected inside, includes the step of providing draw forming at a position near to an edge of at least either side of the door panel.

According to another aspect of the present invention, a method of producing a door for refrigerator, which is composed of a door panel made of metal, an inner panel combined with the door panel, a door cap fitting into the door panel and the inner panel in an upper portion, and a handle fitting into the door panel and the inner panel in a bottom portion, the door for refrigerator having a heat insulating foam material injected inside, includes the steps of providing draw forming at a given position of the door panel, coloring the door panel in two-tone color, and providing the draw forming on a boundary of colors.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
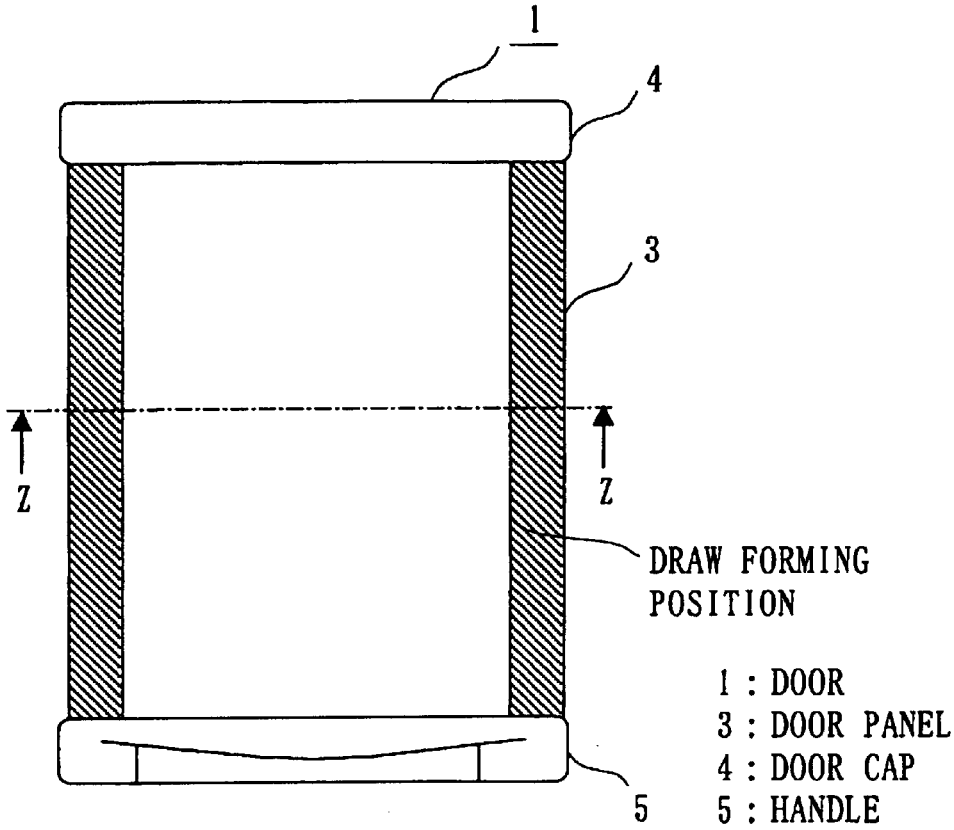
FIG. 1 shows a front view of a door for refrigerator according to a first embodiment of the present invention.

Reference will now be made in detail to the present preferred embodiments of the invention, examples of which are illustrated in the accompanying drawings, wherein like reference numerals indicate like elements through out the several views.

Embodiment 1

Figure 2:
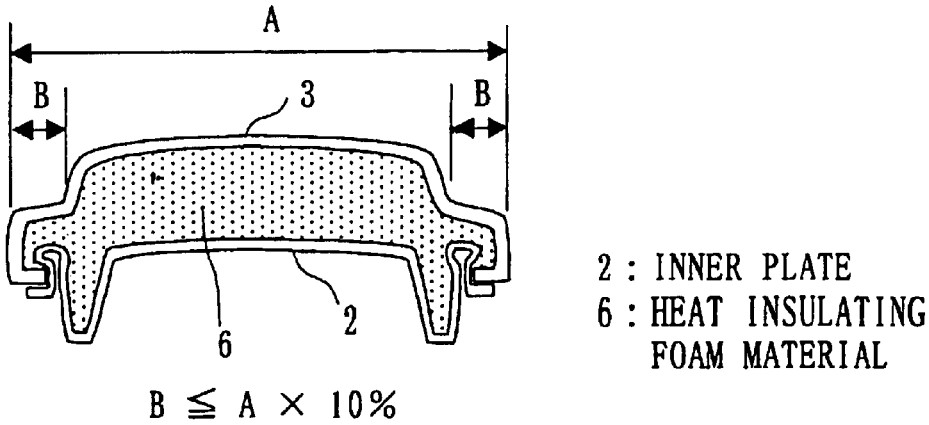
FIG. 2 is a Z—Z sectional view of the door for refrigerator of FIG. 1.

FIG. 1 and FIG. 2 are diagrams illustrating a door for refrigerator according to a first embodiment of the present invention. FIG. 1 shows a front view of the door for refrigerator. FIG. 2 shows a Z—Z sectional view of the door for refrigerator of FIG. 1.

Referring to the figures, a door 1 is composed of the combination of a door panel 3, which is one of the components of a front design view of the door 1, and an inner plate 2, which is provided on an inner side of the door panel 3, and a door cap 4 fitting into the combination on an upper portion and a handle 5 fitting into the combination on a bottom portion. The door 1 is provided inside with a heat insulating form material 6.

The door panel 3 is painted in two-tone color. The color of the shaded portions on the door panel 3 of FIG. 1 is different from the color of the other portions. The two-tone color may be of tones of a color with a touch of relaxation such as a combination of deep blue and light blue or of deep gray and white gray, for example. Furthermore, draw forming is provided on the boundaries of the two-tone color on both sides of the door panel 3 by press working in such a manner as to push the center portion of the door panel 3 outwards to form a convexity. Then, the draw forming is provided at a position of approximately ten percent (10%) of a full width of the door panel 3 away from an edge of the door panel 3 on each side.

Figure 3:
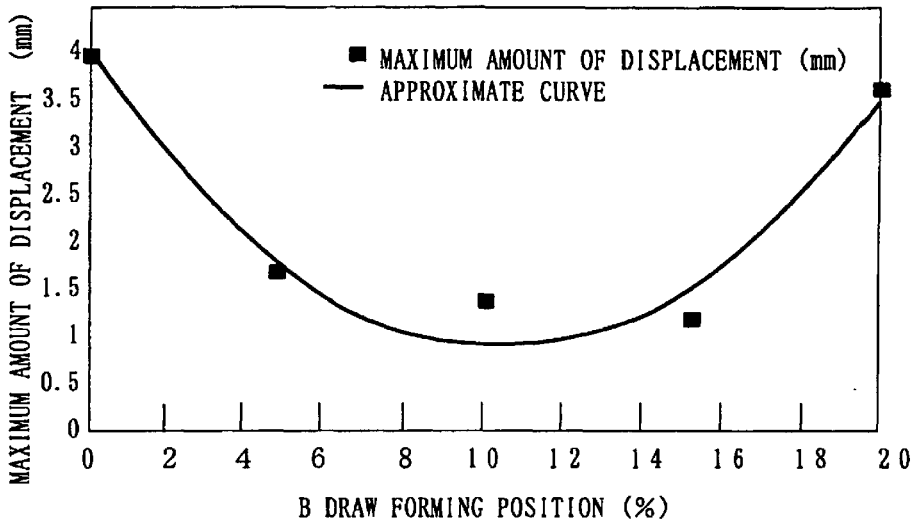
FIG. 3 is a graph illustrating a curve based on a draw forming position on each side of the door panel and a maximum amount of displacement corresponding to the draw forming position according to the first embodiment.
Figure 4:
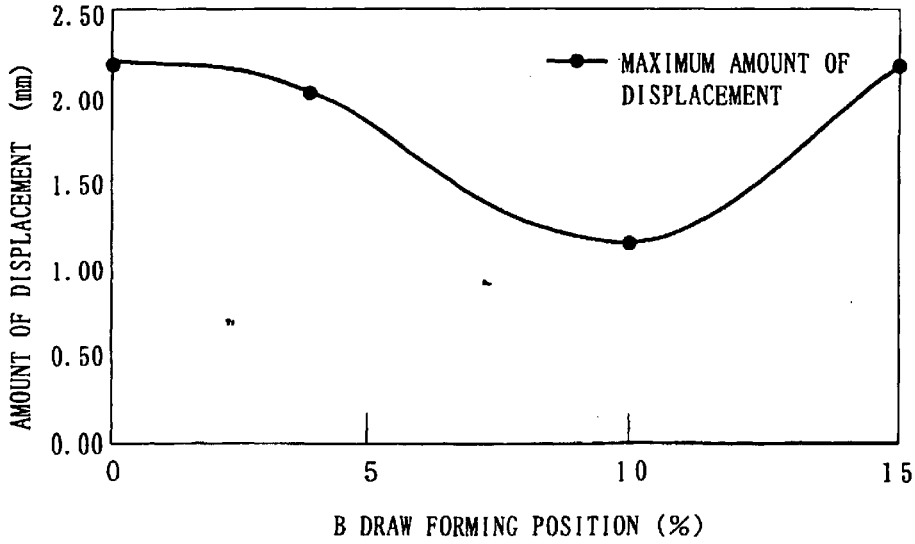
FIG. 4 is a graph illustrating a curve based on a draw forming position on each side of the door panel and a maximum amount of displacement corresponding to the draw forming position according to the first embodiment.

FIG. 3 is a graph illustrating a relation between a draw forming position B and a maximum amount of displacement of the door panel 3 when the draw forming is provided on both sides of the door panel 3. FIG. 4 is a graph illustrating a relation between a draw forming position B and a maximum amount of displacement of the door panel 3 when the draw forming is provided on either side of the door panel 3.

As illustrated in the graphs of FIG. 3 and FIG. 4, the door panel 3 gets most reinforced with a least amount of displacement when the draw forming is provided at a position of approximately ten percent (10%) of the full width of the door panel 3 away from a side edge of the door panel 3. For that reason, the additional sheet metal part needed for the conventional door for refrigerator for the purpose of keeping the door panel 3 from getting uneven on the surface is allowed to be eliminated.

In addition to that, the draw forming is thus provided in such a manner as to push the center portion of the door panel 3 outwards to form a convexity. For that reason, it is possible to secure enough thickness for an efficient heat insulation, thereby achieving less thermal leakage through the door 1.

Furthermore, with a standard module (500–800 in width, 1500–1800 in height) of refrigerator, if the door is designed in such a manner as to give an impression of a frame on the surface of the door on each side, the most effective ratio for the width of the frame (the ratio in which the frame is recognized most effectively) is 10% or less compared to a full width of a door in a front view. For that reason, by placing the draw forming at this most effective position, the design of the door can give the impression that the frame is on the surface of the door on each sided without adding extra separate parts of injection or the like.

Thus, as stated above, according to this embodiment, the door for refrigerator wears an accent in color on both sides of the door panel 3. Alternatively, the accent in color may be provided on either side of the door panel 3. Still alternatively, the draw forming may be provided in any position on the door panel 3 as long as the design of the door is sophisticated enough. For example, the draw forming may be provided at a center portion of the door panel 3 or at any upper and bottom portions of the door panel 3.

It is a positive effect of the door for refrigerator of this embodiment with the draw forming provided at the position near to the edge of at least either side of the door panel that the door panel is allowed to be reinforced. For that reason, the reinforcing sheet metal needed for keeping the door panel from getting uneven on the surface is eliminated. This allows the door for refrigerator to be provided at a lower production cost.

It is another positive effect of the door for refrigerator of this embodiment with the draw forming provided at the position of approximately 10% of the full width of the door panel away from a side edge of the door panel that the door panel is allowed to be most reinforced.

It is still another positive effect of the door for refrigerator of this embodiment with the draw forming provided in such a manner as to push the center portion of the door panel outwards to form a convexity that the heat insulating wall is allowed to secure enough thickness for producing an energy-saving door for refrigerator.

It is still another positive effect of the door for refrigerator of this embodiment with the draw forming provided in the two-tone door panel that the door is allowed to wear an accent in color on both sides or either side thereof. In addition to that, the door for refrigerator of this embodiment is allowed to be provided in the sophisticated design which is associated with a frame without adding extra separate parts and at a lower production cost.

It is still another positive effect of the door for refrigerator of this embodiment with the draw forming provided in any given portion of the door panel, with the door panel painted in two-tone color, and with the draw forming provided on the boundary of the two-tone color that the door panel is allowed to be reinforced, thereby eliminating the reinforcing sheet metal for keeping the door panel from getting uneven on the surface. In addition to that, the door is allowed to wear an accent in color. For that reason, the door for refrigerator of this embodiment is allowed to be sophisticated in design and provided at a lower production cost.

According to a method of producing the door for refrigerator of the present invention, the draw forming may be provided at the position near to the edge of at least either side of the door panel. For that reason, the door panel is allowed to be reinforced, thereby eliminating the reinforcing sheet metal for keeping the door panel from getting uneven on the surface. Consequently, the door for refrigerator is allowed to be provided at a lower production cost.

According to another method of producing the door for refrigerator of the present invention, the draw forming may be provided on a given portion of the door panel, the door panel may be painted in two-tone color, and the draw forming may be provided on the boundary of the two-tone color. For that reason, the door panel is allowed to be reinforced, thereby eliminating the reinforcing sheet metal for keeping the door panel from getting uneven on the surface. In addition to that, the door is allowed to wear an accent in color. This allows the door for refrigerator to be sophisticated in design and provided at a lower production cost.

Embodiment 2

Figure 5:
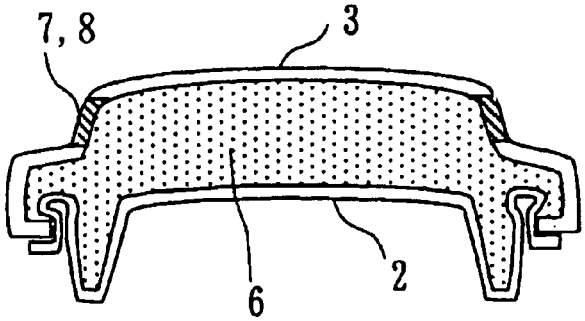
FIG. 5 is a sectional view of a door for refrigerator according to a second embodiment.

FIG. 5 is a sectional view of a door for refrigerator according to a second embodiment. Referring to the figure, a reference numeral 7 denotes a gradation portion having a series of changes of hues. A reference numeral 8 denotes a draw forming portion which is provided on the gradation portion 7. The other portions of the door for refrigerator of FIG. 5 are the same as those discussed with reference to the door for refrigerator of FIG. 2.

In order to absorb displacement caused by press working, the gradation portion 7 is provided on the boundary of the two-tone color, and the draw forming portion 8 is provided on the gradation portion 7.

It is a positive effect of the door for refrigerator of this embodiment with the gradation portion provided between the colors of the two-tone door panel, and with the draw forming portion provided on the gradation portion that the displacement caused by the draw forming press working is prevented.

Embodiment 3

Figure 6:
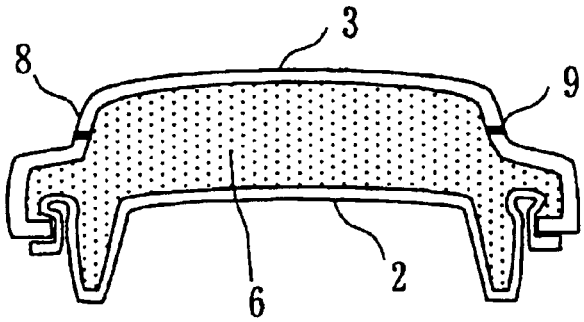
FIG. 6 is a sectional view of a door for refrigerator according to a third embodiment.
Figure 7:
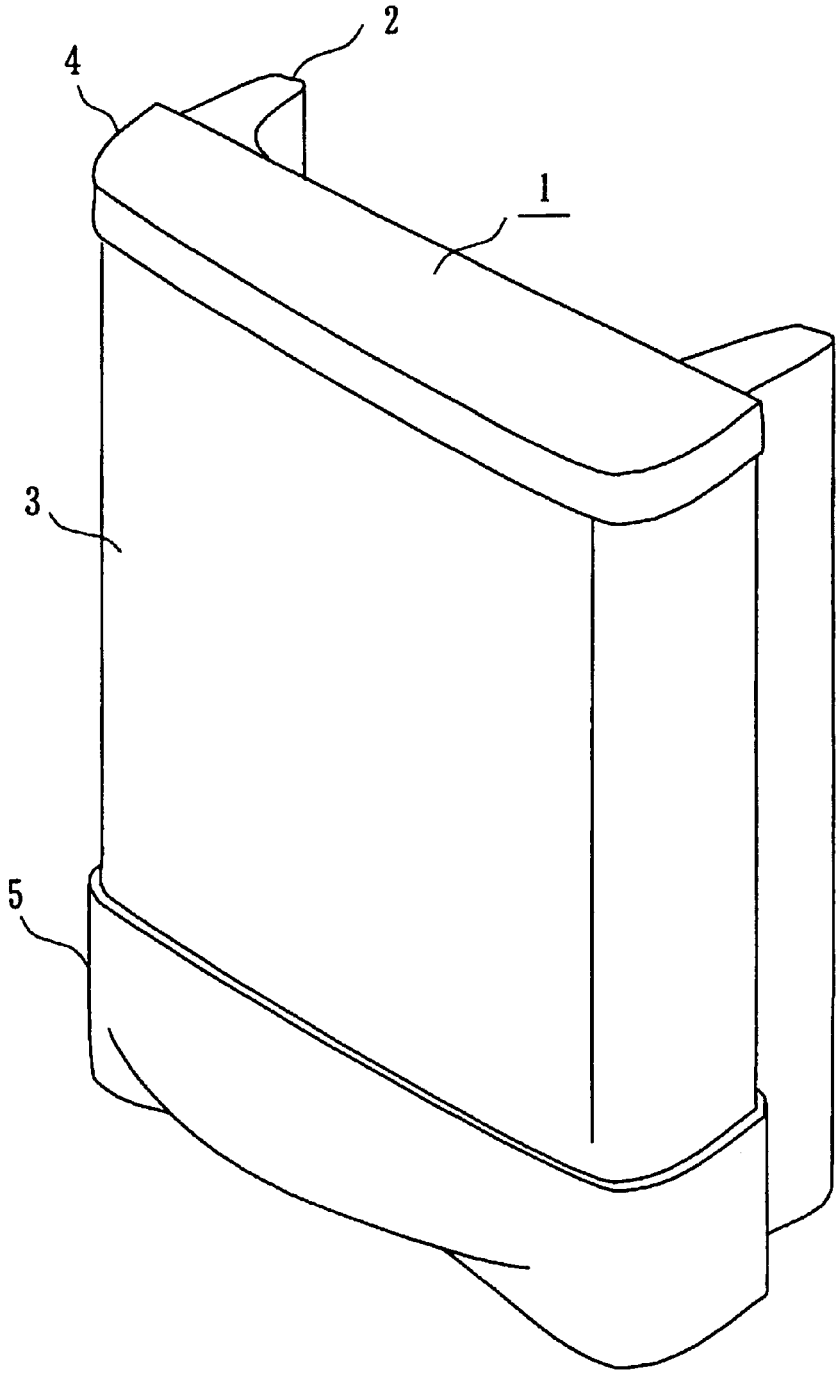
Fig. 7 CONVENTIONAL ART
FIG. 7 is a diagram illustrating a conventional door for refrigerator.

FIG. 6 is a sectional view of a door for refrigerator according to a third embodiment. Referring to the figure, a reference numeral 9 denotes a boundary of two-tone color. The other portions of the door for refrigerator of FIG. 6 are the same as those discussed with reference to the door for refrigerator of FIG. 2 or FIG. 5.

The boundary of two-tone color 9 is placed in a center portion of the draw forming in consideration of displacement caused by press working, thereby allowing the press working to be done easily.

It is a positive effect of the door for refrigerator of this embodiment with the boundary of two-tone color placed at the center portion of the draw forming that the press working is allowed to be done easily.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A door for a comprising:

a inner panel combined with a door panel;

a door cap fitting into the door panel and the inner panel in a bottom portion, the door for the refrigerator having a heat insulating foam material injected inside, wherein draw forming is provided at a position near an edge of at least either side of the door panel at a position away from the edge at approximately between 4 and 16% of a full width of the door panel such that a a metal sheet for keeping the door pane from warping or getting uneven is not required.

2. The refrigerator door of claim 1, wherein the draw forming is provided in such a manner as to push the door panel outwards to form a convexity at a center portion of the door panel.

3. The refrigerator door of claim 1, wherein the door panel has a two-tone color, andthe draw forming is provided on a boundary of colors.

4. A door for a refrigerator having a heat insulating foam material injected therein, the door comprising:

a draw-formed door panel;

a door cap fitting into the draw-formed door panel and the inner panel in a upper portion: and a handle fitting into the draw-formed door panel and the inner panel in a bottom portion, wherein draw forming in the draw-formed door is provided at a position away from the edge at approximately between 4 and 16% of a full width of the draw-formed door panel such that a metal sheet for keeping the door panel from warping or getting uneven is not required, the draw-formed door panel has a two-tone color, and the draw forming is provided on a boundary of colors.

5. The refrigerator door of claims 3 or 4, further comprising:

a gradation portion provided in the two-tone color;

wherein the draw forming is provided on the gradation portion.

6. The refrigerator door of claims 3 or 4, wherein the boundary of the colors is provided close to a center portion of the draw forming.

7. A method of producing a door for a refrigerator which is composed of an inner panel combined with a door panel, a door cap fitting into the door panel and the inner panel in an upper portion, and a handle fitting into the door panel and the inner panel in a bottom portion, the door for refrigerator having a heat insulating foam material injected inside, the method of producing the door for the refrigerator comprising:

draw forming the door panel at a position away from the edge at approximately between 4 16% of a full width of the door panel such that a metal sheet for keeping the door panel from warping or getting uneven is not required.

8. A method of producing a door for a refrigerator which is composed of an inner panel combined with the door panel, a door cap fitting into the door panel and the inner panel in an upper portion, and a handle fitting into the door panel and the inner panel in a bottom portion, the door for refrigerator having a heat insulating foam material injected inside, the method of producing the door for the refrigerator comprising:

draw forming the door panel at a position away from the edge at approximately between 4 and 16% of a full width of the door panel from warping or getting uneven is not required, coloring the door panel in two-tone color, and providing the draw forming on a boundary of colors.

* * * * *